US011713666B2

(12) United States Patent
Al-Shahri et al.

(10) Patent No.: US 11,713,666 B2
(45) Date of Patent: Aug. 1, 2023

(54) SYSTEMS AND METHODS FOR DETERMINING FLUID SATURATION ASSOCIATED WITH RESERVOIR DEPTHS

(71) Applicant: Saudi Arabian Oil Company, Dhahran (SA)

(72) Inventors: Ali M. Al-Shahri, Doha (SA); Khaled Benzaoui, Dhahran (SA); Yahya Abdoh Mohammed Ghuwaidi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/193,602

(22) Filed: Mar. 5, 2021

(65) Prior Publication Data

US 2021/0348499 A1 Nov. 11, 2021

Related U.S. Application Data

(60) Provisional application No. 63/022,863, filed on May 11, 2020.

(51) Int. Cl.
*E21B 47/003* (2012.01)
*E21B 47/04* (2012.01)

(52) U.S. Cl.
CPC ..... *E21B 47/003* (2020.05); *E21B 47/04* (2013.01)

(58) Field of Classification Search
CPC ..... E21B 47/003; E21B 47/04; E21B 47/06; E21B 47/138; G01F 1/64; G01V 5/105; G01V 1/306
See application file for complete search history.

(56) References Cited

U.S. PATENT DOCUMENTS 4,441,362 A * 4/1984 Carlson ..... G01F 1/64 73/61.44
6,980,940 B1 12/2005 Gurpinar et al.
(Continued)

FOREIGN PATENT DOCUMENTS

CN 101031824 B * 5/2010 ..... G01V 5/105
CN 106600693 A 12/2016
(Continued)

OTHER PUBLICATIONS

Sitaresmi "The Study of the Effect of Water Saturation (Sw) on Fractional Flow and Water Cut to Determine Sw Cutoff" Published by International Journal of Engineering Research & Technology (IJERT) http://www.ijert.org ISSN: 2278-0181 vol. 5 Issue 07,Jul. 2016 (Year: 2016).*
(Continued)

*Primary Examiner* — Michael J Dalbo
*Assistant Examiner* — Kaleria Knox
(74) *Attorney, Agent, or Firm* — Dinsmore & Shohl LLP

(57) ABSTRACT

A method for determining a plurality of saturation values is provided. The method accessing, by a computing device, data describing a plurality of fluid volume values associated with a reservoir, the plurality of fluid volume values include a plurality of cumulative water volume values and a plurality of cumulative hydrocarbon values, utilizing, by the computing device, the data describing the plurality of fluid volume values to generate ratio values associated with intervals corresponding to depth levels of the reservoir, generating, by the computing device, a fractional flow graphical representation including the ratio values associated with the intervals corresponding to the depth levels of the reservoir, utilizing, by the computing device, the fractional flow graphical representation including the ratio values to determine saturation values associated with the intervals corresponding to
(Continued)

the depth levels of the reservoir, and generating a saturation graphical representation including the saturation values.

19 Claims, 9 Drawing Sheets

(56) References Cited

U.S. PATENT DOCUMENTS

| | | | | |
|---|---|---|---|---|
| 7,136,757 | B2 * | 11/2006 | Goloshubin | G01V 1/306 702/16 |
| 7,289,942 | B2 | 10/2007 | Yang et al. | |
| 7,408,150 | B1 | 8/2008 | Flaum et al. | |
| 7,566,869 | B2 | 7/2009 | Riley et al. | |
| 7,660,711 | B2 | 2/2010 | Pita et al. | |
| 8,451,683 | B2 | 5/2013 | Chu et al. | |
| 8,908,474 | B2 | 12/2014 | Chu et al. | |
| 9,703,006 | B2 | 7/2017 | Stern et al. | |
| 2006/0036418 | A1 | 2/2006 | Pita et al. | |
| 2007/0016389 | A1 | 1/2007 | Ozgen | |
| 2008/0167849 | A1 | 7/2008 | Hales et al. | |
| 2008/0288226 | A1 | 11/2008 | Gurpinar et al. | |
| 2009/0299714 | A1 | 12/2009 | Kelkar et al. | |
| 2010/0142323 | A1 | 6/2010 | Chu et al. | |
| 2010/0170373 | A1 | 7/2010 | Green | |
| 2010/0206559 | A1 | 8/2010 | Sequeira, Jr. et al. | |
| 2010/0309749 | A1 | 12/2010 | Yogeswaren | |
| 2013/0096896 | A1 | 4/2013 | Al-Shahri | |
| 2013/0096897 | A1 | 4/2013 | Shahri | |
| 2016/0320769 | A1 * | 11/2016 | Deffenbaugh | E21B 47/06 |
| 2019/0085673 | A1 * | 3/2019 | Alshakhs | E21B 49/008 |
| 2021/0310345 | A1 * | 10/2021 | Aqeel | E21B 47/138 |

FOREIGN PATENT DOCUMENTS

| | | | | |
|---|---|---|---|---|
| CN | 110807544 | A | 2/2020 | |
| WO | WO-9957418 | A1 * | 11/1999 | E21B 49/00 |
| WO | 2011100009 | A1 | 8/2011 | |

OTHER PUBLICATIONS

Hans B. Helle "Fluid saturation from logs using committee neural networks".Article in Petroleum Geoscience Jun. 2002 Petroleum Geoscience, vol. 8 2002, pp. 109-118 (Year: 2002).*

Wang et al., "Estimation of Depths of Fluid Contacts and Relative Permeability Curves by History Matching Using Iterative Ensemble-Kalman Smoothers", Society Petroleum Engineers Journal, pp. 509-525, Jun. 2010.

International Search Report and Written Opinion pertaining to Application No. PCT/US2012/060557 dated Mar. 15, 2013.

European Search Report pertaining to Application No. 12787214.1 dated Nov. 26, 2015.

International Search Report and Written Opinion dated Aug. 13, 2021 pertaining to International application No. PCT/US2021/029303 filed Apr. 27, 2021, 18 pages.

Sitaresmi, R., "The Study of the Effect of Water Saturation (Sw) on Fractional Flow and Water Cut to Determine Sw Cutoff", International Journal of Engineering Research & Technology, vol. 5, No. 7, Jul. 1, 2016, pp. 667-670.

Helle, H. B. et al., "Fluid saturation from well logs using committee neural networks", Petroleum Geoscience, vol. 8, No. 2, Jun. 1, 2002, pp. 109-118.

* cited by examiner

SYSTEMS AND METHODS FOR DETERMINING FLUID SATURATION ASSOCIATED WITH RESERVOIR DEPTHS

CROSS REFERENCE

This application claims priority to U.S. Provisional Application Ser. No. 63/022,863, filed on May 11, 2020. The application is also related to U.S. Patent Application Publication Number 2013/0096897, which is incorporated by reference in its entirety in this application.

TECHNICAL FIELD

The present specification relates to systems and methods for determining and generating fluid saturation values, and more particularly, to systems and methods of determining fluid saturation values and generating saturation graphical representations including the determined fluid saturation values, which correspond to different depth levels of one or more reservoirs.

BACKGROUND

Some of the biggest challenges the oil and gas industry faces today are accurately measuring fluid flow values at various depth levels, determining fluid saturation values associated the depth levels of reservoirs, and measuring variations in determined fluid saturation values at different depth levels and across different time frames. Conventional techniques also do not have the functionality to correct inconsistencies related to fluid saturation measurements and accurately predict fluid saturation measurements for future time periods.

Accordingly, a need exists in the industry for determining fluid saturation associated with reservoir depths.

SUMMARY

The present disclosure provides systems and methods for determining saturation values associated with the intervals corresponding to the depth levels of the reservoir is provided. The method includes accessing, by a computing device, data describing a plurality of fluid volume values associated with a reservoir, the plurality of fluid volume values include a plurality of cumulative water volume values and a plurality of cumulative hydrocarbon values, utilizing, by the computing device, the data describing the plurality of fluid volume values to generate ratio values associated with intervals corresponding to depth levels of the reservoir, generating, by the computing device, a fractional flow graphical representation including the ratio values associated with the intervals corresponding to the depth levels of the reservoir, utilizing, by the computing device, the fractional flow graphical representation including the ratio values to determine saturation values associated with the intervals corresponding to the depth levels of the reservoir, and generating a saturation graphical representation including the saturation values.

In another embodiment, a system that is configured to determine saturation values associated with the intervals corresponding to the depth levels of the reservoir is provided. The system includes a processor and a memory component that stores logic that, when executed by the processor, causes the system to perform the steps of accessing data describing a plurality of fluid volume values associated with a reservoir, generating, using the data describing the plurality of fluid volume values, ratio values associated with intervals corresponding to depth levels of the reservoir, generating a fractional flow graphical representation including the ratio values associated with the intervals corresponding to the depth levels of the reservoir, determining, using the fractional flow graphical representation including the ratio values, saturation values associated with the intervals corresponding to the depth levels of the reservoir, the determining of the saturation values is based on an interpolation algorithm, and generating a saturation graphical representation including the saturation values.

In yet another embodiment, a non-transitory computer-readable medium that stores logic that, when executed by a computing device, causes the computing device to: access data describing a plurality of fluid volume values associated with a reservoir, generate, using the data describing the plurality of fluid volume values, ratio values associated with intervals corresponding to depth levels of the reservoir, generate a fractional flow graphical representation including the ratio values associated with the intervals corresponding to the depth levels of the reservoir, the fractional flow graphical representation including a water ratio metric associated with a first depth level and a different water ratio metric associated with a second depth level, determine, using the fractional flow graphical representation including the ratio values, saturation values associated with the intervals corresponding to the depth levels of the reservoir, the determining of the saturation values is based on an interpolation algorithm, and generate a saturation graphical representation including the saturation values.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the disclosure. The following detailed description of the illustrative embodiments can be understood when read in conjunction with the following drawings, where like structure is indicated with like reference numerals and in which.

DETAILED DESCRIPTION OF THE DISCLOSURE

Embodiments of the present disclosure are directed to systems and methods for determining fluid saturation values associated with various depth levels of a reservoir. Embodiments provided herein are configured for determining fluid saturation values and generating saturation graphical representations based on these saturation values. Some embodiments are configured to access a plurality of fluid volume values (e.g., a plurality of cumulative water volume values, a plurality of cumulative hydrocarbon volume values, etc.) associated with a reservoir, generate ratio values that describe relationships (e.g., slope values) between the differences in the interval water volume values at the depth levels and the total fluid values at different depth levels in the reservoir. Additionally, some embodiments are configured to analyze the ratio values that are included as part of fractional flow graphical representation (e.g., fractional flow curve) to determine saturation values associated with various depth levels in the reservoir. These embodiments may generate a saturation graphical representation that includes saturation values that are predicted for various depth levels in the reservoir across one or more time periods (e.g., months, years, etc.).

In particular, the saturation graphical representations include dry interval levels and wet interval levels, which may be generated using various supervised machine learning techniques. For example, dry interval levels may be determined using back propagation techniques and wet interval levels may be determined using forward propagation techniques. Other supervised machine learning techniques having the characteristics and output results comparable to back propagation and forward propagation may also be utilized. The determination of dry interval levels and wet interval levels enables for a better understanding of the relationships between fluid volume values and fluid flow rates at various depth levels of one or more reservoirs over various time periods. As such, data that improves overall production from reservoirs, e.g., portions of the reservoir that are suitable for the installation of one or more wells, the intervals of existing wells that are capable of producing high levels of hydrocarbons, and variations in fluid flows over different time periods (e.g., future time frames) may be more effectively identified. Consequently, the likelihood of installing high producing future wells and increasing the production from existing wells may be improved. The methods and systems of the present disclosure are depicted, in part in FIGS. 1-9, each of which will be described in detail in the present disclosure. It is noted that a reference may be made interchangeably between one or more of FIGS. 1-9 during a description of any one of FIGS. 1-9.

Figure 1:
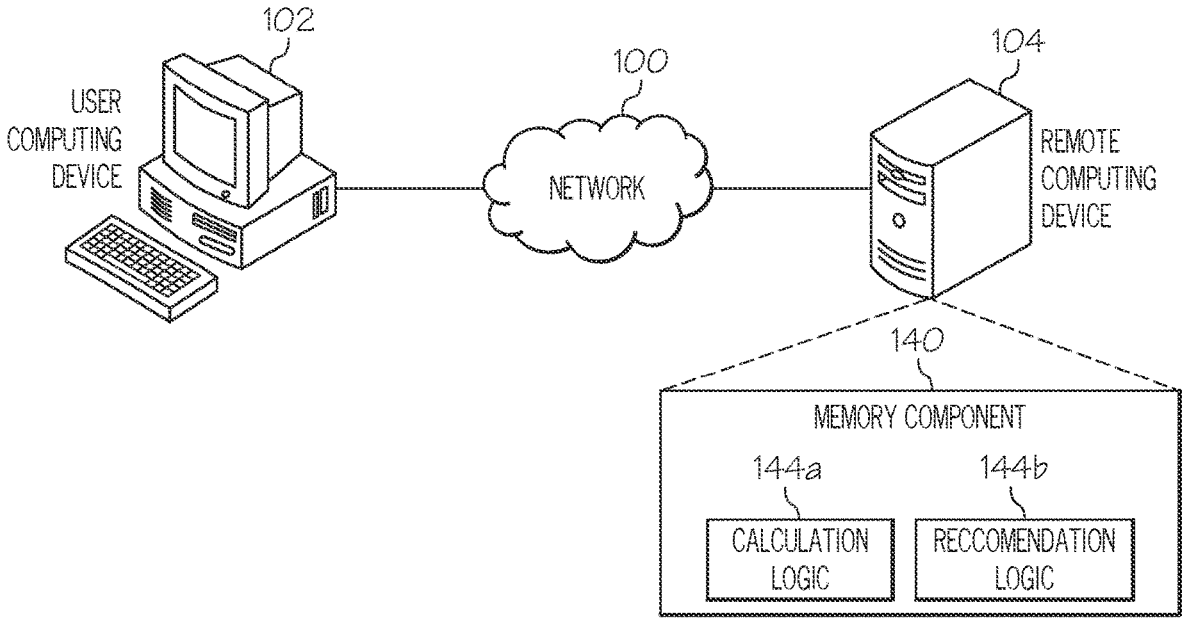
FIG. 1 depicts a computing environment for determining saturation values associated with various intervals corresponding to the depth levels of a reservoir, according to embodiments provided herein.

FIG. 1 depicts a computing environment for determining and generating saturation values associated with various intervals of wells corresponding to depth levels of a reservoir, according to embodiments provided herein. The embodiment of FIG. 1 illustrates a network 100 coupled to a user computing device 102 and a remote computing device 104. The network 100 may include any wide area network (such as the internet, cellular network, mobile data network, WiMAX network, etc.), any local network (such as a local area network, Wi-Fi network, mesh network, etc.), and/or any peer-to-peer network (such as via Bluetooth, ZigBee, etc.). The user computing device 102 may be configured as any personal computer, laptop, mobile device, database, server, etc. for interfacing with a user and thus may include input devices and output devices for facilitating such interface. The remote computing device 104 may include any server, database, personal computer, tablet, mobile device, and/or other device for storing data and/or performing the calculations described herein. As depicted in FIG. 1, the remote computing device 104 may include a memory component 140 that stores various types of data, e.g., fluid volume data, reservoir properties and classifications data, fluid ratio data, fluid saturation data, etc.

The remote computing device 104 may include a memory component 140 that stores calculation logic 144*a* and recommendation logic 144*b*. As described in more detail below, the calculation logic 144*a* may be configured for causing a computing device (such as the user computing device 102 and/or the remote computing device 104) to analyze fluid volume data at various depth levels of a reservoir, perform various calculations in order to generate ratio values, determine saturation values, etc. The recommendation logic 144*b* may cause a computing device (such as the user computing device 102 and/or the remote computing device 104) to recommend a specific action, initiate generation of graphical representations, etc. It is noted that, the methods and systems for determining saturation values and generating a saturation graphical representation may be implemented using a combination of the user computing device 102 and the remote computing device 104.

In some embodiments, a method for generating saturation graphical representations is described. The graphical representation may be a two-dimensional or three dimensional representation that is generated using data describing a plurality fluid volume values associated with one or more reservoirs. In order to generate saturation graphical representations, data describing a plurality of fluid volume values associated with a reservoir are accessed. For example, data is obtained from flow meters that may be positioned at various depth levels and in association with one or more perforated intervals of a well. These flow meters measure the flow rates of fluids (e.g., oil, water, etc.) at these intervals. Such fluid flow data may be gathered for a plurality of depth levels of wells installed across a plurality of reservoirs having different properties. In some embodiments, in addition to data gathered from flow meters, data describing fluid flow may be obtained from open hole logs, cased hole logs, pulsed neutron logs ("PNL logs"), Carbon-Oxygen logs, and flow meter logs.

A reservoir, as described in this disclosure, may include a subsurface body of rock or a combination of subsurface rocks such that porosity and permeability values may vary at each of these depth levels. The plurality of fluid volumes may relate to volumes of cumulative fluid present at a particular depth level of the reservoir, e.g. based on aggregation of water volume values from a certain depth level to the surface of the reservoir, aggregation of hydrocarbon volume values from a certain depth level to the surface of the reservoir, etc. The cumulative fluid may be measured from this particular depth level to the surface of the reservoir during a particular time frame. A well may be a combination of one or more structural components that are installed within an aperture dug into one or more portions of the reservoir. The well is utilized to extract fluids from the reservoir. The dimensions of the well, the size of the aperture, etc., may vary depending on the properties of the reservoir, among other factors. In some embodiments, the data related to these fluids may be included as part of a graphical representation as depicted in FIG. 2.

Figure 2:
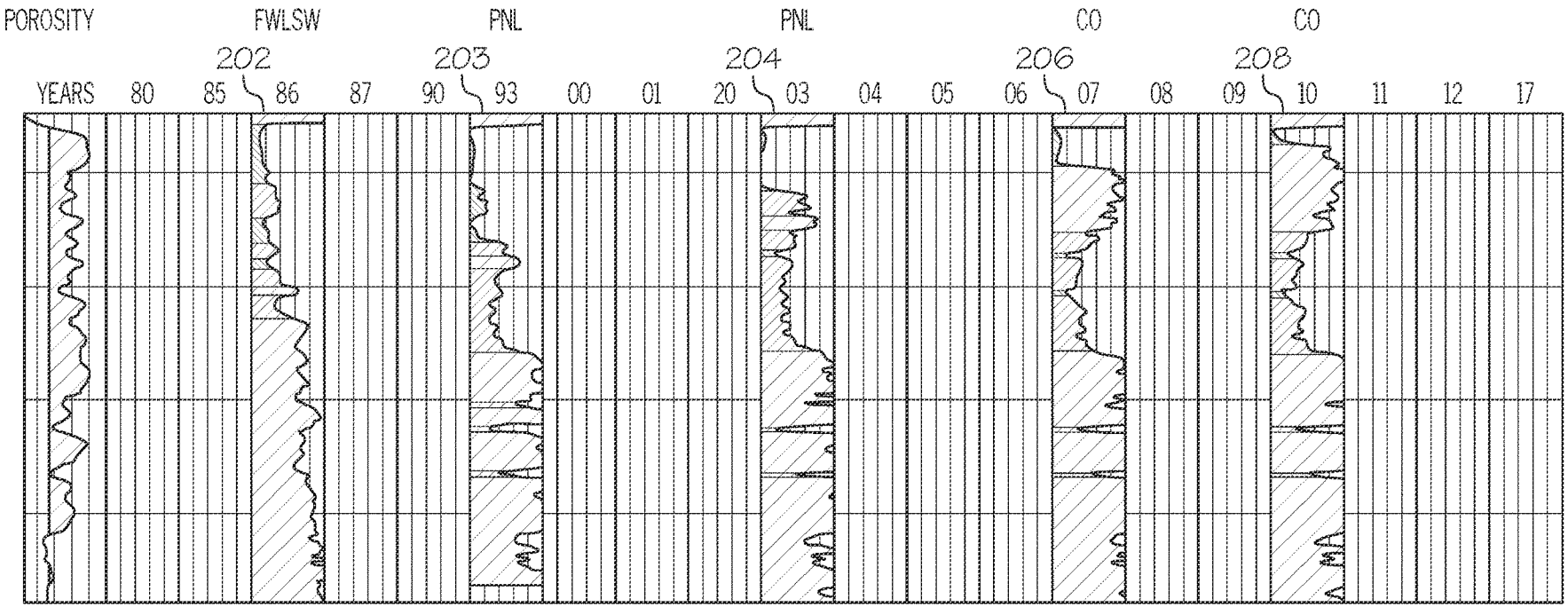
FIG. 2 illustrates a graphical representation of fluid saturation values associated with one or more reservoirs and/or wells installed within these reservoirs over a time frame, according to one or more embodiments described herein.

FIG. 2 illustrates a graphical representation of fluid saturation values associated with one or more reservoirs and/or wells installed within these reservoirs over various time periods, according to one or more embodiments described herein. In particular, FIG. 2 illustrates a graphical representation of variations in fluid saturation values along different depth levels of one or more reservoirs. The x-axis of the graphical representation is a time scale and the y-axis relates to various depths along reservoirs. As illustrated, saturation variation ranges 202, 203, 204, 206, and 208 depict fluid saturation variations (e.g., variations in water saturation values) at different depth levels during the years 1986, 1993, 2003, 2007, and 2010. In particular, as illustrated by saturation variation range 202 in year 1986, water saturation levels near the top of the reservoir (e.g., near the surface of the reservoir) are low (as indicated by the striped pattern having a small distance between each line) when compared to the water saturation levels at higher depth levels (as indicated by the striped pattern having a larger distance between each line). In contrast, water saturation levels near the top of years 2007 and 2010 may be comparable to the water saturation at higher depth levels.

However, fluid saturation data is not depicted for years 1987-1992, 2000-2002, 2004-2006, 2008-2009, 2011, 2012, and 2017. As stated, during these time periods, data related to fluid saturation (e.g., water saturation) may be limited, inaccurate, corrupted, or non-existent, which prevents having an accurate understanding of fluid saturation levels. Thus, the likelihood of installing wells in appropriate locations in order to extract fluids effectively is reduced. The system described herein generates saturation values at different depth levels of one or more reservoirs during at least some of the years in which fluid saturation data is limited or corrupted using the techniques and processes described herein. A step in these processes includes the generation of fluid ratio values (e.g., water cut values) at various depth levels of a reservoir as are described and illustrated in FIGS. 3 and 4.

Figure 3:
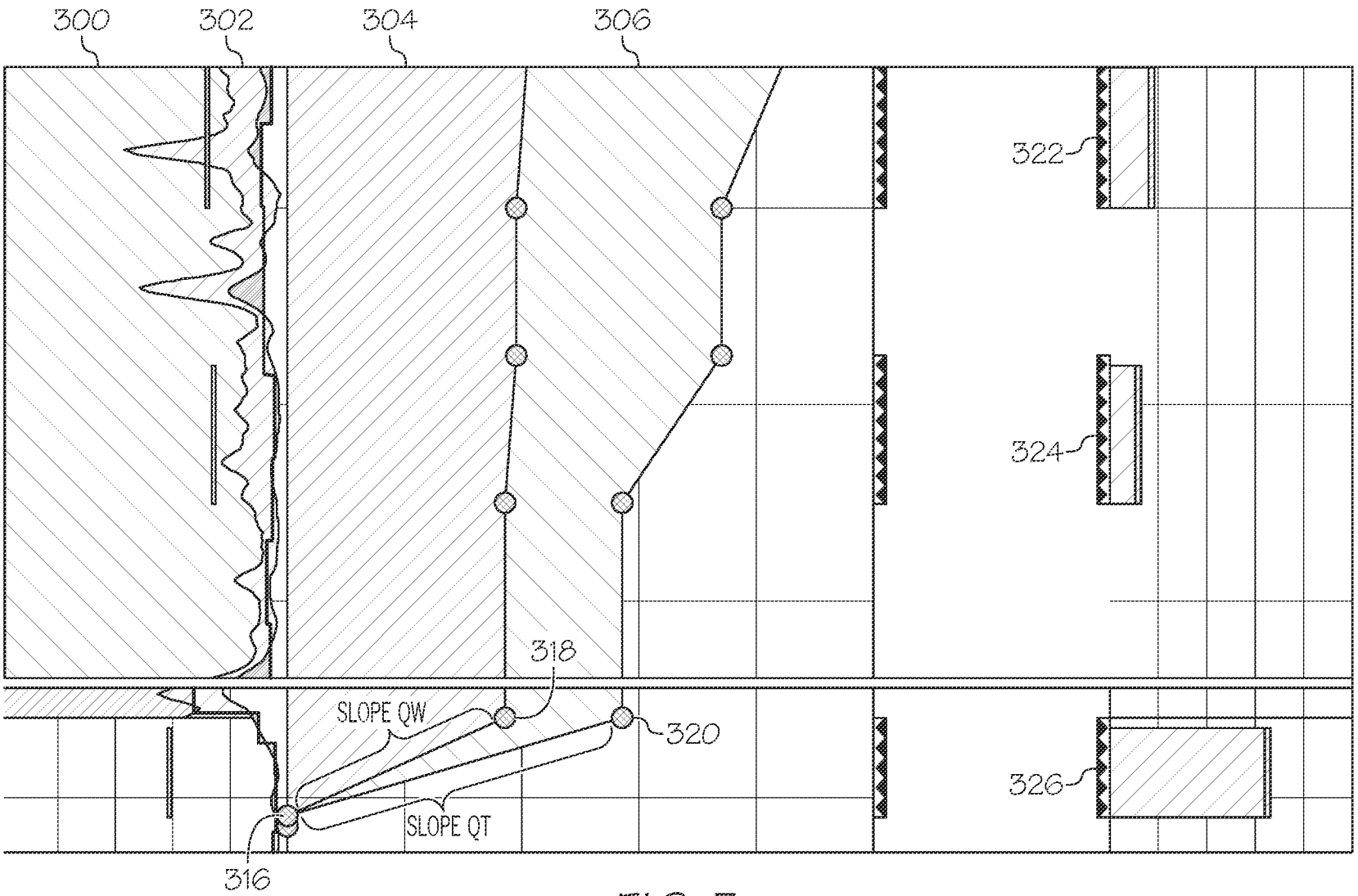
FIG. 3 schematically depicts a graphical representation of variations in oil levels and water levels across various depth levels and at various time frames, which are utilized to generate ratios, according to one or more embodiments described and illustrated herein.

FIG. 3 schematically depicts a graphical representation of variations in oil levels and water levels across various depth levels and at various time frames, which are utilized to generate fluid ratios, according to one or more embodiments described and illustrated herein. As illustrated, an example cumulative oil level 300 (indicated with a first striped pattern) is very high. During this time (an example year), the quantity of hydrocarbons within the reservoir is substantial, as hydrocarbons appear to be present at all depth levels in the reservoir. As also illustrated, the hydrocarbons appear to occupy a significant portion of a particular reservoir as compared to example water levels 302. In some embodiments, such a relationship between hydrocarbons and water may be present when a suitable reservoir is selected and a well may initially have been drilled. In this embodiment, production activities (e.g., extraction of hydrocarbons) may not have commenced.

At another example year, another example water level 304 and another example oil level 306 are depicted. In contrast to example oil levels 300 and water levels 302, the amounts of oil and water levels have changed such that there appears to be approximately an equivalent amount of water for a particular oil level across multiple depths in the reservoir. In order to generate ratio values (e.g., water cut values), the fluid volume values associated with various depth levels in the reservoir are analyzed. In some embodiments, a cumulative level of oil and a cumulative level of water associated at a specific depth level (e.g., depth level 316) is determined. The cumulative level of oil and water at depth level 316 relates to a total quantity or volume of water and oil respectively that is present from the depth level 316 to the surface of the reservoir.

Additionally, the depth level 318 at a different portion of the reservoir, a proportion of water to oil is depicted as being higher relative to the depth level at 316. In other words, the proportion of water (or rate at which water may enter a perforation of a well relative to the oil in the reservoir) may have increased at depth level 318 as compared to the depth level 316, which may have been because a certain amount of hydrocarbons may have already been extracted from the reservoir. It is noted that at depth level 320 in a different portion of the reservoir, a proportion of oil (e.g., rate at which oil may enter a perforation of a well relative to the water in the reservoir) has decreased at depth level 320 as compared to a different depth level (e.g., a deeper depth level). This shift in the proportion of cumulative water and oil in the reservoir (or water and oil rates at a particular depth level) may occur as a result of the extraction of hydrocarbons, various production activities, etc.

In some embodiments, an interval water volume value (e.g., a first interval water volume value) corresponding to the depth level 316 (e.g., a first depth level) at a particular location in the reservoir and a different water volume value (e.g., a second interval water volume value) corresponding to the depth level 318 (e.g., a second depth level) at a different location in the reservoir may be determined. Additionally, a total fluid quantity value (e.g., a first interval total fluid value) corresponding to the depth level 316 in a location of the reservoir and a different total fluid volume value (e.g., a second interval total fluid value) corresponding to the depth level 320 in a different location in the reservoir may be determined.

In some embodiments, a water fraction value describing a relationship between the variations in the water volumes at depth levels 316 and 318 is determined. For example, the water fraction value may be a slope value that is determined using the interval water volume value corresponding to the depth level 316 (e.g., the first interval water volume value) and the different water volume value (e.g., the second interval water volume value) corresponding to the depth level 318. This slope value describes a variation in the water volume levels at different depths, e.g., over a particular time frame as a result of hydrocarbon extraction, production activities, etc.

In some embodiments, a fluid fraction value describing a relationship between variations in the total amount of interval fluids at depth levels 316 and 320 respectively, is determined. For example, the fluid fraction value may have a slope value that is determined using a total fluid interval volume value (e.g., the first total interval fluid value) corresponding to the depth level 316 and another total fluid volume value (e.g., the second total interval fluid value) corresponding to the depth level 320. This slope value describes a variation in the total fluid levels across different depths. The total fluid volume values describe quantities of water, hydrocarbons, and a combination of one or more fluids that may be present at any given time at a particular depth level in the reservoir. Additionally, the variations in the fluid levels from depth level 316 to depth level 318 may have occurred over a certain time frame (e.g., over months or years, during which production activities may have been conducted, which reduces the amount of oil as compared to the water in the reservoir).

Using the determined water fraction value and the total fluid fraction value, a water ratio metric (e.g., a water cut value) may be generated. Additional water fraction values and total fluid fraction values may be also be generated for intervals corresponding to various depth levels from the deepest portion of the reservoir (e.g., lowest depth levels of the reservoir) to the surface. As depicted in FIG. 3, water ratio metrics 322, 324, and 326 (e.g., different water cut values) are associated with various depth levels in the reservoir. In some embodiments, water cut values may be determined for a plurality of perforations or intervals associated with a plurality of wells (e.g., 500 wells, 1000 wells, etc.) installed in one or more reservoirs over a certain time frame (e.g., 25 to 50 years). A larger number of wells and a longer time frame may also be contemplated.

The determined water cut values may be utilized to generate a fractional flow graphical representation that includes the water cut values (e.g. water ratio metrics). The fractional flow graphical representation (e.g., a fractional flow curve) may be utilized to generate saturation values associated with a plurality of intervals corresponding to the depth levels of the reservoir. In some embodiments, if a particular water fraction value and a total fluid fraction value is determined in association with two intervals at different depth levels of a reservoir is "0" (e.g., no variation), it may be determined that the particular interval is either closed or unperforated.

Additionally, a set of water cut values determined for intervals of a well in one or more reservoirs may be classified under a particular rock type. For example, the distinct properties of a particular reservoir (e.g., porosity values, permeability values, etc.) may be used to classify the reservoir as a particular rock type or under a rock classification. There may be a plurality of rock classifications or rock types with certain designations, e.g., rock type 1, rock type 2, rock type 3, rock type 4, rock type 5, etc. Each of these rock types may have a distinct fractional flow curve or fractional flow profile.

Figure 4:
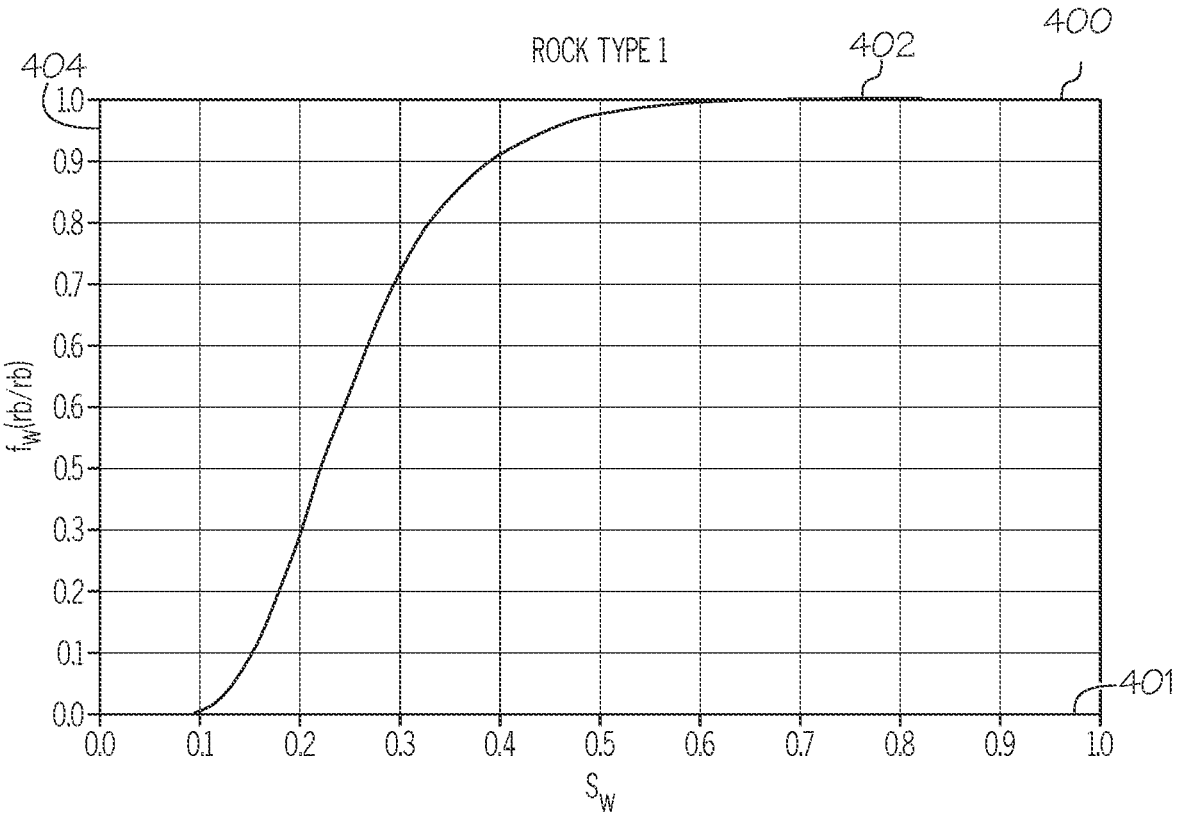
FIG. 4 depicts an example graphical representation corresponding to a particular rock classification of a reservoir that includes a plurality of water cut values utilized to identify a plurality of water saturation values, according to one or more embodiments described and illustrated herein.

FIG. 4 depicts an example graphical representation 400 corresponding to a particular rock classification of a reservoir that includes a plurality of water cut values utilized to identify a plurality of saturation values, according to one or more embodiments described and illustrated herein. As illustrated, an example fractional flow curve 402 indicates a plurality of water cut or water ratio metrics on the y-axis 404 at increments of 0.10 ranging from 0 to 1.0. Additionally, the x-axis 401 depicts saturation values ranging from 0.10 to 1.0 in increments of 0.10. The techniques described herein may utilize the determined water ratio metrics (e.g., water cut values) to calculate water saturation values. For example, a set of water cut values may be included as part of the fractional flow curve and these values, as included on the y-axis, may be interpreted to identify corresponding water saturation values. Specifically, the determined water cut values may be compared to points on the fractional flow curve, whose shape is based on the properties of the reservoir in which one or more wells may be installed. These water cut values may be utilized to identify a corresponding water saturation level on the fractional flow curve. In this way, a plurality of water saturation values may be determined for a plurality of intervals of wells associated with various depth levels in one or more reservoirs.

The determined water saturation values enable designers and engineers to accurately and effectively identify water quantities associated with various intervals, which enables them to better understand portions of wells that may be capable of higher levels of productivity. In other words, knowledge of these water saturation values may be enabled for the effective determination of the proportion of water to other fluids (e.g., hydrocarbons), which aids in the likelihood of a more effective extraction of hydrocarbons from one or more intervals of wells.

Figure 5:
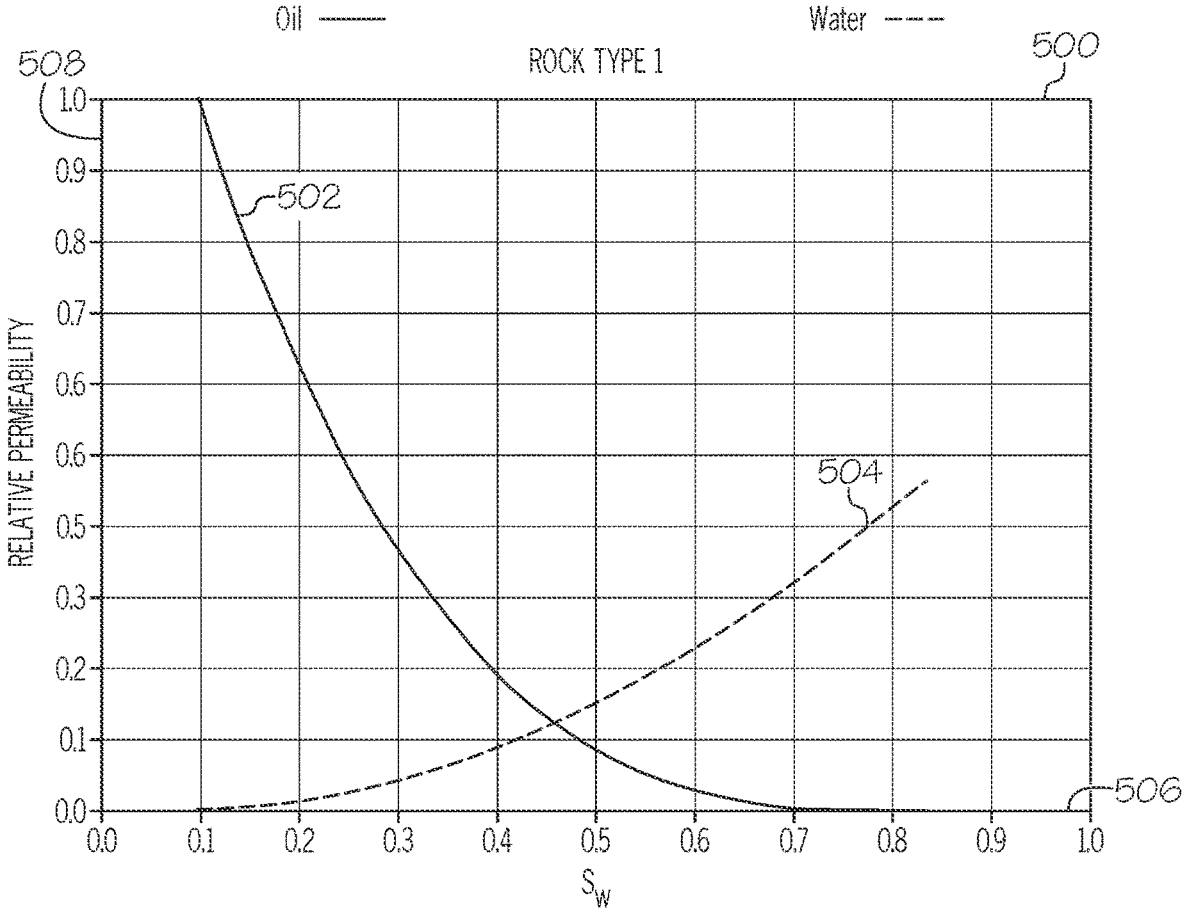
FIG. 5 depicts another graphical representation that depicts an oil curve and a water curve in an example reservoir classified as a rock type, according to one or more embodiments described and illustrated herein.

FIG. 5 depicts another graphical representation 500 that depicts an oil curve 502 and a water curve 504 in an example reservoir classified under a rock type, according to one or more embodiments provided herein. In particular, an x-axis 506 of the example graphical representation 500 depicts saturation levels that range from 0.0 to 1.0 in increments of 0.1. Additionally, a y-axis 508 depicts relative permeability levels of the reservoir that is classified under the "rock type 1", ranging from 0.0 to 1.0 and shown in increments of 0.1. As illustrated, water curve 504 is depicted as having very low permeability levels when the saturation level is 0.1. With a water saturation level of 0.1, the corresponding permeability level on the oil curve 502 is 1.0. Additionally, with the increase in the saturation levels along x-axis 506, the relative permeability levels along the oil curve 502 decreased from 1.0 to 0.0. In contrast, with the increase in saturation levels along the x-axis 506, the relative permeability levels along the water curve 504 increased from 0.1 to approximately 0.85.

Figure 6:
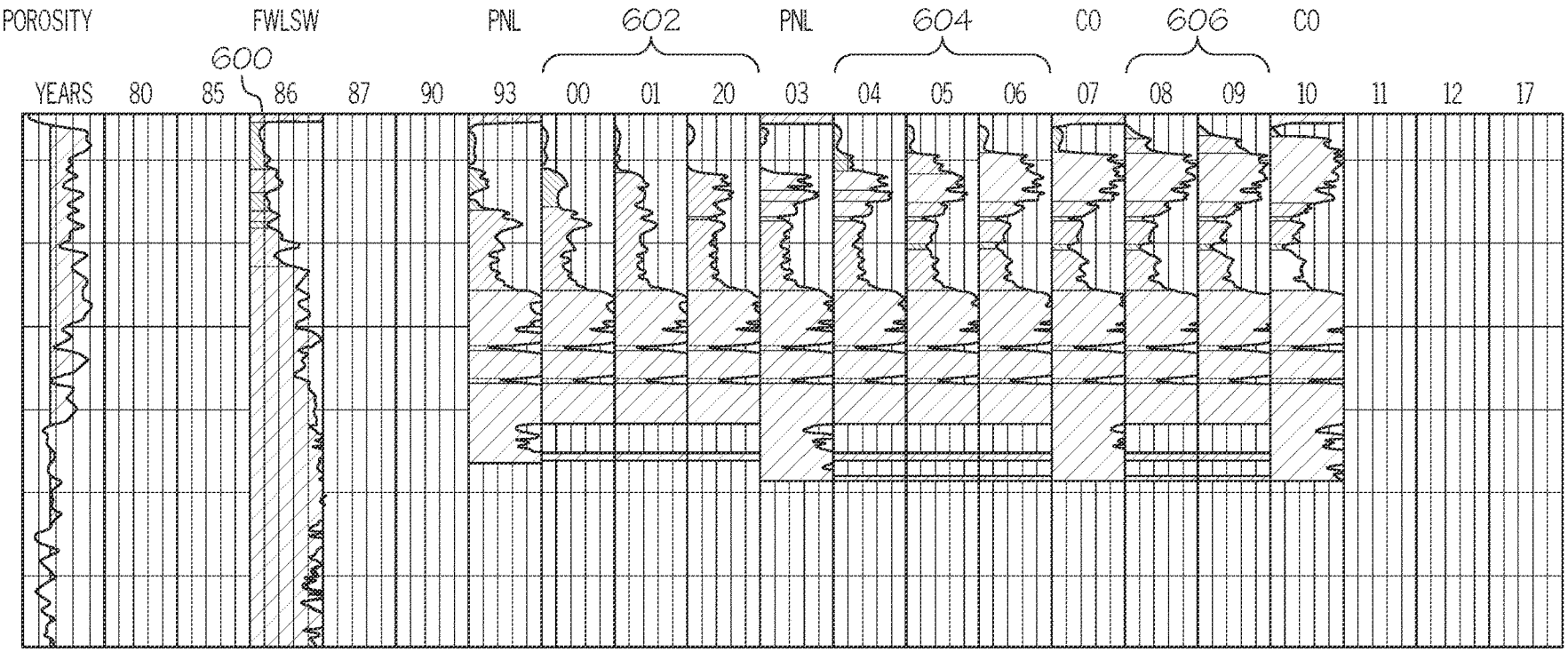
FIG. 6 depicts a graphical representation of pseudo fluid saturation logs for a plurality of years that are generated based on saturation values that are determined as described above, according to one or more embodiments described herein.

FIG. 6 depicts a graphical representation 600 of pseudo fluid saturation logs for a plurality of years that are generated based on saturation values that are determined as described above, according to one or more embodiments provided herein. In particular, a specific pseudo fluid saturation log is generated for the time periods 602, 604, 606. These time periods correspond with years 2001, 2002, 2003, 2004, 2005, 2006, and 2008 and 2009, respectively. For each of these time periods, in order to generate the pseudo fluid saturation logs (e.g., water saturation values corresponding to intervals of wells associated with various depth levels of one or more reservoirs), analysis and interpolation may be performed on water cut values (e.g., using an interpolation algorithm). These water cut and water saturation values are determined using fractional flow curves of a plurality of reservoirs, each of which may have a specific rock type and distinct rock properties (e.g., porosity values, permeability values, depth, dimensions, etc.). The analysis and interpolation that is performed incorporates and tracks changes in fluid saturation values (water saturation values) at various depth levels associated with a plurality of intervals of one or more wells.

In some embodiments, the changes in properties of the reservoirs (e.g., changes in porosity, permeability, etc.) over a certain time frame may also be analyzed. Based on this analysis and interpolation, pseudo fluid saturation logs (e.g., the likely levels of water saturation values) at various intervals of wells (at different depth levels in one or more reservoirs) is generated. The predicted fluid saturation values (e.g., water saturation values) enables for a more accurate determination of the levels of oil production (e.g., extraction of hydrocarbons from one or more intervals of wells in one or more reservoirs) over a particular time period.

Figure 7:
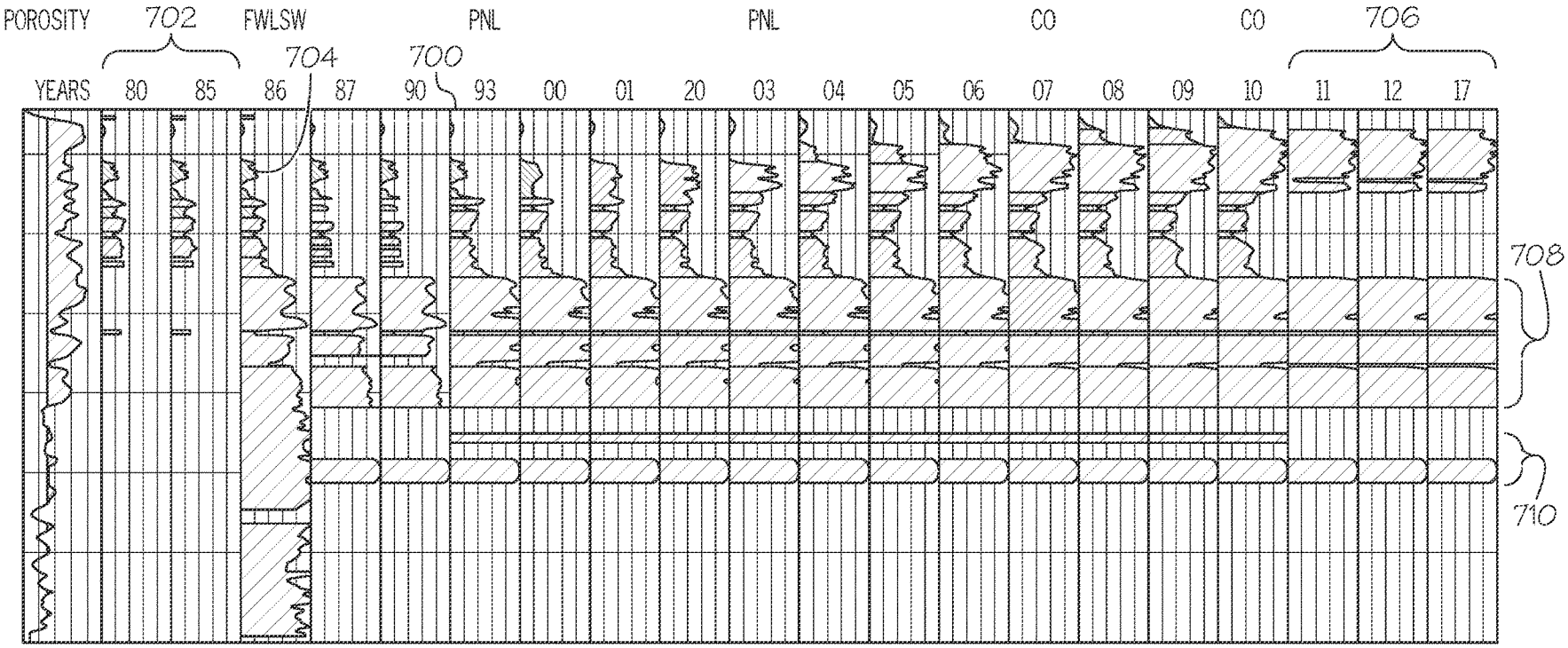
FIG. 7 depicts another graphical representation that includes dry interval levels based on backward propagation, wet intervals based on forward propagation, and the pseudo fluid saturation logs depicted in FIG. 6, according to one or more embodiments described and illustrated herein.

FIG. 7 depicts another graphical representation that includes dry interval levels based on backward propagation, wet intervals based on forward propagation, and the pseudo wells depicted in FIG. 6, according to one or more embodiments provided herein. In particular, the dry interval levels 702 that are determined for years 1980 and 1985, which correspond to particular depth levels in one or more reservoirs, may be generated based on interpreting and analyzing accurate and available data related to year 1986 (among other years). For example, the dry interval levels 704 that are present in years 1986, which are based on available and accurate data, may be interpreted and analyzed, e.g., using backpropagation techniques, to determine the dry interval levels 702. In some embodiments, backpropagation techniques or "backward propagation of errors" is an algorithm for supervised learning of artificial neural networks using gradient descent. For example, based on an artificial neural network and an error function, the backpropagation techniques may enable determination of gradients of error functions with respect to neural network weights. Other techniques are also contemplated.

Additionally, wet interval levels 706, 708, 710 associated with different depth levels for years 2011, 2012, and 2017 may also be determined by analyzing and interpreting accurate and available data for the year 2010 (among other years) using forward propagation techniques. Forward propagation is a supervised machine learning based technique that is utilized to make predictions. For example, data is "forward propagated" or input and processed through multiple layers of a neural network, such that data is input into a first layer of a neural network, and the output from the first layer is input into another layer of the neural network. Unlike other supervised machine learning techniques, data is input and processed only in one direction, e.g., forward. In other words, there are no cycles or loops such that data is output from a particular layer of a neural network and sent back to another layer of the neural network.

Figure 8:
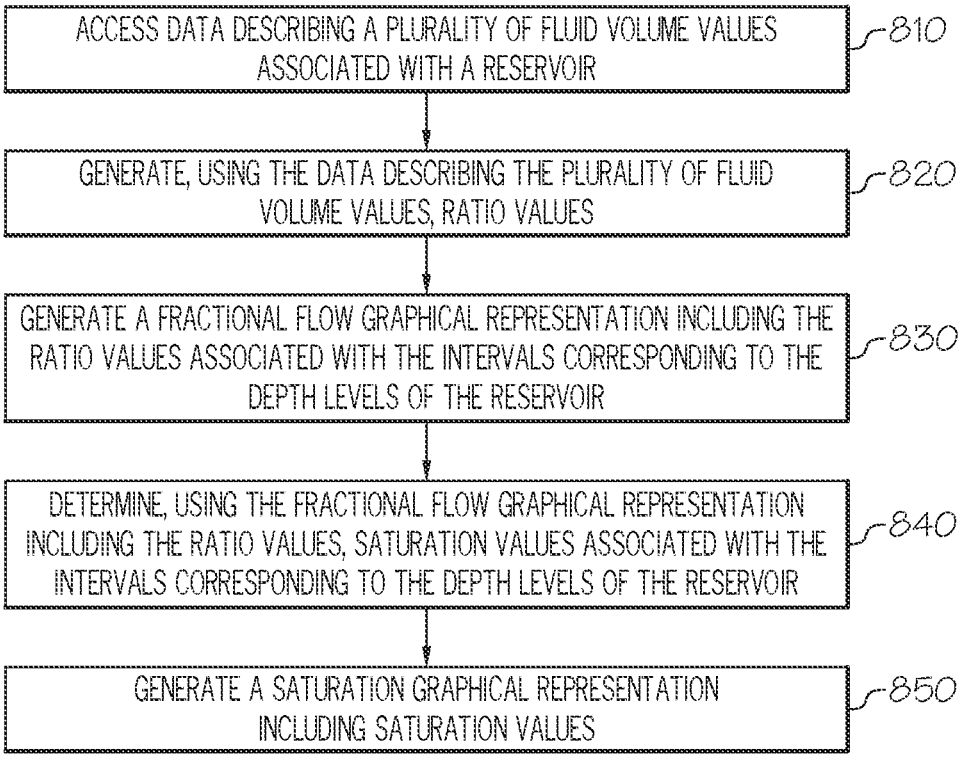
FIG. 8 depicts a flowchart of a method for generating a saturation graphical representation including the saturation values associated with a plurality of intervals of wells that are associated with a plurality of depth levels in one or more reservoirs.

FIG. 8 depicts a flowchart of a process for generating a saturation graphical representation including the saturation values associated with a plurality of intervals of wells that are associated with a plurality of depth levels in one or more reservoirs. In block 810, data describing a plurality of fluid volume values associated with a reservoir (or reservoirs) is accessed. In some embodiments, the accessed data may have been captured by flow meters placed at or near intervals of wells that are installed in one or more reservoirs. These intervals may be located at a plurality of depth levels in one or more reservoirs, and each of these depth levels may have distinct rock properties (e.g., porosity values, permeability values, etc.). The data describes various flow rates of fluids, e.g., oil flow rates, water flow rates, etc. These fluid rates may be associated with a particular depth level in a reservoir that may correspond with an interval of a well. Additionally, fluid flow data may also be obtained from open hole logs, cased hole logs, pulsed neutron logs ("PNL"), Carbon-Oxygen logs, and flow meter logs. Other such databases are also contemplated. In some embodiments, the fluid volume values may relate to quantities of cumulative fluid present in a reservoir at or during a particular time period. The cumulative fluid amount or volume may be measured from a particular depth of a reservoir (which may correspond to intervals of one or more wells installed in the reservoir) to the surface of the reservoir.

In block 820, ratio values associated with intervals corresponding to depth levels of the reservoir (or reservoirs) is generated, using the data describing the plurality of fluid volume values. To generate ratio values (e.g., water cut values), the plurality of fluid volume values are analyzed. As described above with reference to FIG. 3, the ratio values may be generated by initially determining interval water volume values and total fluid volume values corresponding to depth levels at different locations in the reservoir. Additionally, relationships between the differences in the interval water volume values at the depth levels and the total fluid volume values at different depth levels in the reservoir may be determined (e.g., slope values associated with the differing interval water volume values and total interval fluid values).

In block 830, a fractional flow graphical representation including the ratio values associated with the intervals corresponding to the depth levels of the reservoir are generated. The fractional flow graphical representation may be generated as a two-dimensional or three-dimensional representation. In some embodiments, the fractional flow graphical representation may illustrate ratio values (e.g., water cut values) on the y-axis and water saturation values on the x-axis.

In block 840, saturation values associated with intervals corresponding to the depth levels of the reservoir is determined using the fractional flow graphical representation including the ratio values. Specifically, the determined ratio values may be utilized to identify corresponding water saturation values on the fractional flow curve. It is noted that the shape of the fraction flow curve, and by extension, the relationship between the water cut values and the water saturation values, may vary depending on the properties of the reservoir. In some embodiments, the reservoir may be classified into various rock types based on different properties of the reservoir, e.g., variations in porosity and permeability values across different depth levels that may correspond to intervals of one or more wells installed in the reservoir. As such, variations in water cut values may correspond to a wide range of water saturation values depending on the fractional flow curves associated with the different rock types.

In block 850, a saturation graphical representation including the saturation values is generated. Examples of saturation graphical representations are depicted in FIGS. 6 and 7. Specifically, pseudo fluid saturation levels (e.g., water saturation levels) or predictions of fluid saturation levels at various depth levels of the reservoir, which may correspond to various intervals of wells installed in the reservoir, are generated. These pseudo fluid saturation levels are generated by analyzing and interpolating the fluid saturation values (e.g., water saturation values) and ratio values (e.g., water cut values), using the techniques described above. Specifically, back propagation techniques or "backward propagation of errors" may be utilized for determining dry interval levels associated with various depth levels in a reservoir over certain time periods, and forward propagation techniques may be utilized to determine wet intervals associated with different depth levels for certain time periods. Other techniques for determining wet intervals and dry intervals are also contemplated.

Figure 9:
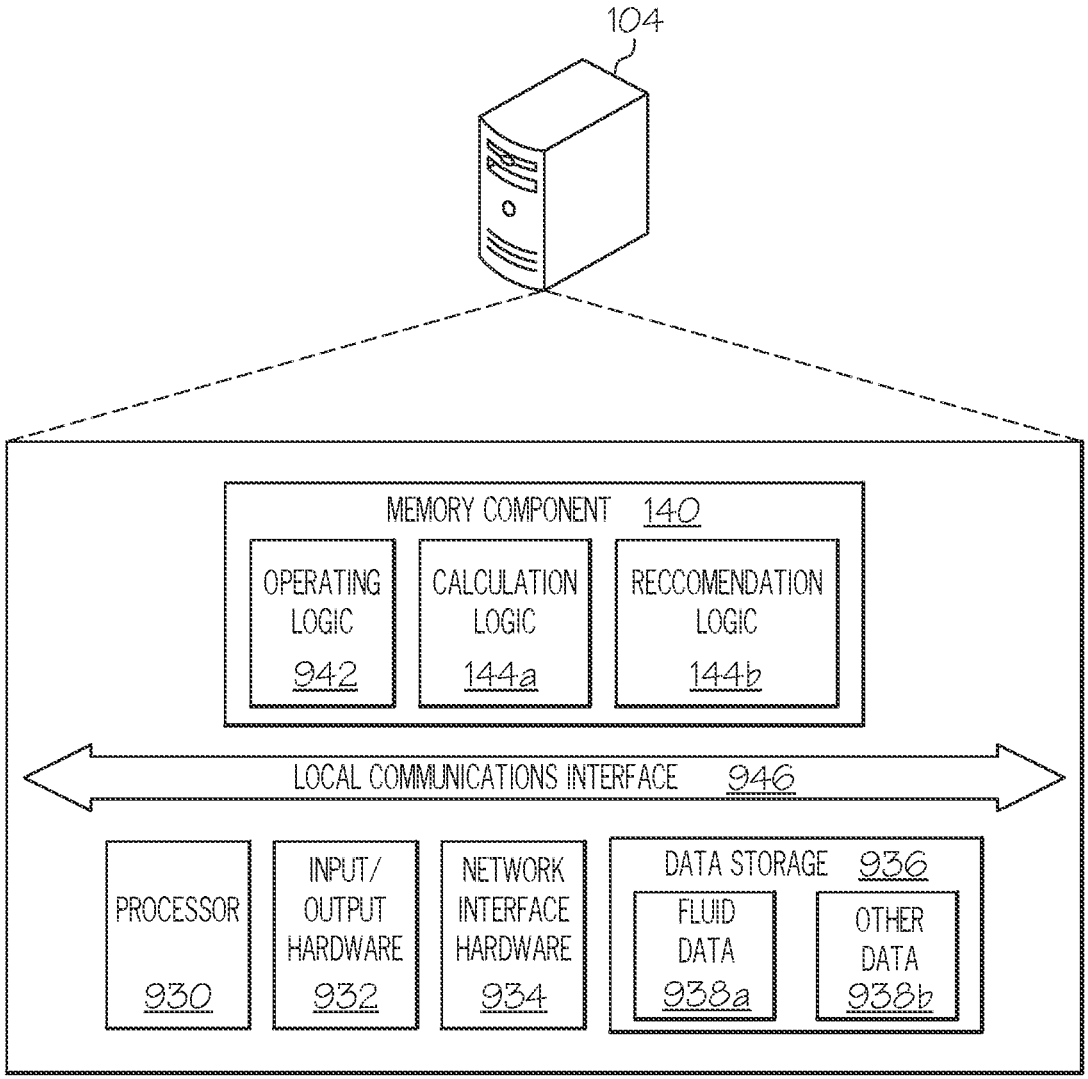
FIG. 9 depicts a remote computing device for determining saturation values and generating a saturation graphical representation

FIG. 9 depicts a remote computing device 104 for determining saturation values and generating a saturation graphical representation including the saturation values, according to embodiments provided herein. As illustrated, the remote computing device 104 includes a processor 930, input/output hardware 932, a network interface hardware 934, a data storage component 936 (which stores fluid data 938*a* and/or other data 938*b* as described with reference to FIG. 2), and a memory component 140. The memory component 140 may be configured as volatile and/or nonvolatile memory and as such, may include random access memory (including SRAM, DRAM, and/or other types of RAM), flash memory, secure digital (SD) memory, registers, compact discs (CD), digital versatile discs (DVD) (whether local or cloud-based), and/or other types of non-transitory computer-readable medium. Depending on the particular embodiment, these non-transitory computer-readable mediums may reside within the remote computing device 104 and/or external to the remote computing device 104.

The memory component 140 may store operating logic 942, the calculation logic 144*a*, and the recommendation logic 144*b*. Each of these logic components may include a plurality of different pieces of logic, each of which may be embodied as a computer program, firmware, and/or hardware, as an example. A local interface 946 is also included in FIG. 9 and may be implemented as a bus or other communication interface to facilitate communication among the components of the remote computing device 104.

The processor 930 may include any processing component operable to receive and execute instructions (such as from a data storage component 936 and/or the memory component 140). As described above, the input/output hardware 932 may include and/or be configured to interface with speakers, microphones, and/or other input/output components.

The network interface hardware 934 may include and/or be configured for communicating with any wired or wireless networking hardware, including an antenna, a modem, a LAN port, wireless fidelity (Wi-Fi) card, WiMAX card, mobile communications hardware, and/or other hardware for communicating with other networks and/or devices. From this connection, communication may be facilitated between the remote computing device 104 and other computing devices.

The operating logic 942 may include an operating system and/or other software for managing components of the remote computing device 104. As discussed above, the calculation logic 144*a* may reside in the memory component 140 and may be configured to cause the processor 930 to perform the calculations and depict the interfaces and plots described herein. The recommendation logic 144*b* may be configured to cause the processor 930 to provide the recommendations of type of water management strategy and/or provide locations and other details regarding that recommendation.

It should be understood that certain embodiments described herein are to a method of accessing data describing a plurality of fluid volume values associated with a reservoir, generating, using the data describing the plurality of fluid volume values, ratio values associated with intervals corresponding to depth levels of the reservoir, generating a fractional flow graphical representation including the ratio values associated with the intervals corresponding to the depth levels of the reservoir, determining, using the fractional flow graphical representation including the ratio values, saturation values associated with the intervals corresponding to the depth levels of the reservoir, generating a saturation graphical representation including the saturation values.

The terminology used herein is for the purpose of describing particular aspects only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. The term "or a combination thereof" means a combination including at least one of the foregoing elements.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A method comprising:

accessing, by a computing device, data describing a plurality of fluid volume values associated with a reservoir, the plurality of fluid volume values include a plurality of cumulative water volume values and a plurality of cumulative hydrocarbon volume values;

utilising, by the computing device, the data describing the plurality of fluid volume values to generate water cut values associated with intervals corresponding to depth levels of the reservoir;

generating, by the computing device, a fractional flow curve including the water cut values associated with the intervals corresponding to the depth levels of the reservoir;

utilizing, by the computing device, the fractional flow curve including the water cut values to determine saturation values associated with the intervals corresponding to the depth levels of the reservoir; and generating a saturation graphical representation including the saturation values, wherein the saturation graphical representation includes dry interval levels and wet interval levels, wherein the dry interval levels are determined using back propagation techniques and wherein the wet interval levels are determined using forward propagation techniques.

2. The method of claim 1, wherein generating the water cut values associated with the intervals corresponding to the depth levels of the reservoir includes determining a first interval water volume value associated with a first depth level and a second interval water volume value associated with a second depth level.

3. The method of claim 1, further comprising determining a water fraction value based on a first interval water volume value and a second interval water volume value.

4. The method of claim 1, further comprising determining a first interval total fluid value, a second interval total fluid value, and a total fluid fraction value based on the first interval total fluid value and the second interval total fluid value.

5. The method of claim 1, wherein generating the water cut values associated with the intervals corresponding to the depth levels of the reservoir include s combining a water fraction value based on a first interval water volume value and a second interval water volume value and a total fluid fraction value based on a first interval total fluid value and a second interval total fluid value.

6. The method of claim 5, further comprising generating, based on the combining, a water ratio metric associated with a first depth level and a different water ratio metric associated with a second depth level.

7. The method of claim 1, wherein the fractional flow curve includes a water ratio metric associated with a first depth level and a different water ratio metric associated with a second depth level.

8. The method of claim 1, wherein determining the saturation values associated with the intervals includes performing at least an interpolation algorithm on at least a water ratio metric.

9. The method of claim 1, wherein the plurality of cumulative water volume values are based on an aggregation of water volume values corresponding to a plurality of depth levels of the reservoir.

10. The method of claim 1, wherein the plurality of cumulative hydrocarbon volume values are based on an aggregation of hydrocarbon volume values corresponding to a plurality of depth levels of the reservoir.

11. A system comprising:

a processor; and a memory component that stores logic that, when executed by the processor, causes the system to perform at least the following:

access data describing a plurality of fluid volume values associated with a reservoir;

generate, using the data describing the plurality of fluid volume values, water cut values associated with intervals corresponding to depth levels of the reservoir;

generate a fractional flow curve including the water cut values associated with the intervals corresponding to the depth levels of the reservoir;

determine, using the fractional flow curve including the water cut values, saturation values associated with the intervals corresponding to the depth levels of the reservoir, wherein determining the saturation values is based on an interpolation algorithm; and generate a saturation graphical representation including the saturation values, wherein the saturation graphical representation includes dry interval levels and wet interval levels, wherein the dry interval levels are determined using back propagation techniques and wherein the wet interval levels are determined using forward propagation techniques.

12. The system of claim 11, wherein the plurality of fluid volume values include a plurality of cumulative water volume values.

13. The system of claim 11, wherein the memory component stores logic that, when executed by the processor, causes the system to further perform at least the following:

determine a water fraction value based on a first interval water volume value and a second interval water volume value.

14. The system of claim 11, wherein the memory component stores logic that, when executed by the processor, causes the system to further perform at least the following:

determine a first interval total fluid value and a second interval total fluid value.

15. The system of claim 11, wherein the fractional flow curve includes a water ratio metric associated with a first depth level and a different water ratio metric associated with a second depth level.

16. The system of claim 11, wherein the memory component stores logic that, when executed by the processor, causes the system to further perform at least the following: determine a plurality of cumulative hydrocarbon volume values based on an aggregation of hydrocarbon volume values corresponding to a plurality of depth levels of the reservoir.

17. A non-transitory computer-readable medium that stores logic that, when executed by a computing device, causes the computing device to:

access data describing a plurality of fluid volume values associated with a reservoir;

generate, using the data describing the plurality of fluid volume values, water cut values associated with intervals corresponding to depth levels of the reservoir;

generate a fractional flow curve including the water cut values associated with the intervals corresponding to the depth levels of the reservoir, the fractional flow curve including a water ratio metric associated with a first depth level and a different water ratio metric associated with a second depth level;

determine, using the fractional flow curve including the water cut values, saturation values associated with the intervals corresponding to the depth levels of the reservoir, the determining of the saturation values is based on an interpolation algorithm; and generate a saturation graphical representation including the saturation values, wherein the saturation graphical representation includes dry interval levels and wet interval levels, wherein the dry interval levels are determined using back propagation techniques and wherein the wet interval levels are determined using forward propagation techniques.

18. The non-transitory computer-readable medium of claim 17, wherein the non-transitory computer readable medium stores logic that, when executed by the computing device, further causes the computing device to determine a plurality of cumulative water volume values based on an aggregation of water volume values corresponding to a plurality of depth levels of the reservoir.

19. The non-transitory computer-readable medium of claim 17, wherein the plurality of fluid volume values include a plurality of cumulative hydrocarbon volume values.

* * * * *